US009067112B2

(12) United States Patent
Hart

(10) Patent No.: US 9,067,112 B2
(45) Date of Patent: Jun. 30, 2015

(54) TRAINING DEVICE AND PIVOTAL SWING METHOD FOR IMPROVING ACCURACY OF HITTING A BALL WITH A BAT

(71) Applicant: Roger U. Hart, San Diego, CA (US)

(72) Inventor: Roger U. Hart, San Diego, CA (US)

( * ) Notice: Subject to any disclaimer, the term of this patent is extended or adjusted under 35 U.S.C. 154(b) by 208 days.

(21) Appl. No.: 13/737,934

(22) Filed: Jan. 9, 2013

(65) Prior Publication Data

US 2013/0143695 A1 Jun. 6, 2013

Related U.S. Application Data

(63) Continuation-in-part of application No. 13/517,599, filed on Jun. 14, 2012, now abandoned, which is a continuation of application No. 12/753,898, filed on Apr. 4, 2010, now abandoned, which is a continuation-in-part of application No. 11/541,592, filed on Oct. 2, 2006, now abandoned.

(60) Provisional application No. 60/815,450, filed on Jun. 20, 2006.

(51) Int. Cl.
*A63B 69/00* (2006.01)
*A63B 69/38* (2006.01)

(52) U.S. Cl.
CPC ..... *A63B 69/0002* (2013.01); *A63B 69/0015* (2013.01); *A63B 69/38* (2013.01); *A63B 2069/0008* (2013.01); *A63B 2243/0004* (2013.01); *A63B 2243/0008* (2013.01); *A63B 2243/0016* (2013.01); *A63B 2243/0083* (2013.01)

(58) Field of Classification Search
USPC ..... 473/451–453
See application file for complete search history.

(56) References Cited

U.S. PATENT DOCUMENTS

| | | | | |
|---|---|---|---|---|
| 6,375,581 | B1 * | 4/2002 | Urban et al. | 473/215 |
| 2007/0167264 | A1 * | 7/2007 | Heep | 473/452 |
| 2013/0040763 | A1 * | 2/2013 | Davidson | 473/422 |

OTHER PUBLICATIONS

"Baseball Instruction: Swing", Web Site, Jun. 4, 2004, 3 pages.*
"Bat Angle" Web Site from "Goodswing.com" Apr. 14, 2005, 1 page.*
"The Swing Plane" Web Site from "beabetterhitter.com" Mar. 3, 2005 2 pages.*

* cited by examiner

*Primary Examiner* — Mark Graham
(74) *Attorney, Agent, or Firm* — David B. Waller

(57) ABSTRACT

A training method for measuring detrimental movements to more accurately deliver a bat to a ball, including positioning a stiff and straight leading or front leg at the start of and during the process until after contact with the ball, pointing and planting the leading or front foot at least partially in the direction from which the ball is traveling, positioning the hands and the bat such that the distal end of the bat is below the shoulders and the bat is held substantially parallel to the ground at the start of the process, delivering the bat directly forward in the same plane as the ball is traveling, and utilizing pivoting of the torso and hips about an axis to deliver the bat to a ball with little or no forward or lateral movement of the body.

8 Claims, 8 Drawing Sheets

TRAINING DEVICE AND PIVOTAL SWING METHOD FOR IMPROVING ACCURACY OF HITTING A BALL WITH A BAT

CROSS REFERENCE TO RELATED APPLICATIONS

This application is a continuation of U.S. patent application Ser. No. 13/517,599 filed on Jun. 14, 2012, which in turn is a continuation-in-part of U.S. patent application Ser. No. 12/753,898 filed on Apr. 4, 2010, which in turn is a continuation-in-part of U.S. patent application Ser. No. 11/541,592 filed on Oct. 2, 2006, which in turn is a nonprovisional of 60/815,450 filed Jun. 20, 2006, the entireties of which are hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of sports, and more specifically toward a training device and training method for pivotally swinging and hitting a baseball or softball. Swinging a baseball or softball bat (a simple machine), to hit a baseball or softball, also called "hitting" or "a swing," is a process that involves a number of discrete steps or elements. Some of these steps can or must be performed sequentially, while other steps can or must be performed in parallel. If each of the steps or a combination thereof, is not performed optimally, the outcome will be negatively affected.

The term hitting is defined herein as any condition in which a person, i.e. the "batter," uses his or her hands to swing a bat at a ball with the intent to strike the ball. Often the ball follows a trajectory toward the batter after having been thrown or hit by a person or another device. Examples of this condition are found in the games of baseball and fast-pitch softball. Other such conditions exist. A "great hit" is a desired output, such as a line drive in baseball, and is created by the optimal connection between the bat and the ball. This optimal connection occurs when the center line of the bat hits the center line of the ball, producing the result of both the bat and ball, at the instantaneous moment of contact, traveling in the same plane in opposite directions, with the bat reversing the direction (changing the state) of the ball to an essentially opposite direction of its travel prior to contact with the bat. In addition to the two aspects described above with regard to the optimal connection, there is a third aspect to the optimal connection, namely that of the direction of the ball after coming into contact with the bat. For example, a great hit in baseball has a directional limit defined by the first and third baselines of the playing field. Other games have similar directional limitation ranges for a desired hit outcome. Although the above information regarding a "great hit" as a desired output of baseball is fully applicable to the game of softball, other games in which the ball hitting swing method is used may have a different desired output and the description of a "great hit" in each will have to be adjusted for that game.

Numerous studies have been conducted and several books written about the mechanics and science involved in the "optimal" baseball swing. One can observe that often, very slight differences are depicted in each of these books on the methods they propose or describe. One reason for this is that each type of baseball swing is dealing with a very difficult environment: a process that must consistently, regardless of where the ball is thrown in the strike zone, place the center line of the bat within three-eighths of an inch of the center line of the ball that can be moving at one-hundred miles-per-hour (MPH). This entire process must be completed within two-tenths of a second, from the first movement of the batter to contact with the ball. This overall environment of the hitting process clearly establishes that very small changes can result in significant improvements. Thus an improved process that gives the batter a reduction in head movement, better balance, longer time to see the ball, less time to deliver the bat to the ball, or a method that helps deliver the bat to the ball travelling at speeds of one-hundred MPH more accurately by one-tenth of an inch, will give the user of that process significantly improved results. This is why apparent small or subtle changes are worthy of new books to explain them and patents to protect them. However, rarely is a new and novel process encountered that can so radically change a batter's results. The changes involved with this new training device and pivotal swing method disclosed herein are unique and useful. The unexpected and improved results encountered when using the current training device and method show the importance and significance of the training device and pivotal swing method.

Misconceptions and bad practices have been propagated throughout games involving swings, and through time. For example, head movement during a swing can have a substantial adverse impact on the desired output, such as the quality, direction, and altitude of a hit. The more a batter's head moves, the harder it is for the mind and the rest of the body to deliver the bat to the precise location with the right timing to achieve a great hit. Accordingly, conventional swing methods continue to utilize techniques that, unless changed appropriately, will continue to yield suboptimal results.

The current training device and method for the pivotal swing method disclosed herein has made changes that reduce head movement, in addition to other improvements mentioned below, resulting in better accuracy or precision of bat placement to the specific location of the pitched ball and a better quality hit. It is a significant improvement over the prior art because it has been shown to improve the hitting of essentially all users. Methods that have such consistent and far reaching effects can have a profound impact in their field.

Using baseball as an example, most past and recent swing development has been primarily focused on power; for example, the application of increased force through the bat to a ball. However, more power exerted by a batter, or at least if power is the primary focus of the swing, typically results in an increase in head movement, poor balance, or other factors that can reduce the accuracy of the swing. This reduced accuracy and precision is exemplified by the increase in the number of strikeouts and lower batting averages of "power" batters. The high correlation between strikeouts and power batters does not mean that power is not achievable without the increase in strikeouts, but rather that the design of the swing must incorporate elements that eliminate or reduce the detrimental effects of trying to generate power, such as the increased head movement and poor balance that results in increased strikeouts. In many games, such as baseball and fast-pitch softball, what is important is not so much the power in a swing, but the quality of the energy transfer from the bat to the ball and the ability to hit the ball to a desired strategic location.

Quality hits include power, but not at the expense of accuracy. Accuracy requires a much higher emphasis on a swing that is simplified and contains no or negligible head movement. Although it is still debatable, time has shown that the players and teams that generate the most hits will win the most games. Accordingly, it would be beneficial to many players and teams to adhere to a hitting technique that increases hitting accuracy, and hence, the player's or team's winning percentage.

Simplification of the swing developed with use of the current training device and method is advantageous when it contributes to less time required to deliver the bat to the ball and more accuracy of the placement of the bat to the precise location of the ball at the right timing. Simplifying and improving the baseball swing, if done correctly, can give the batter more time to assess which balls to swing at and where to place the bat for the best quality hit. Starting and delivering the bat in the same plane the ball is traveling in is a form of simplification. When the bat starts in or near the plane the ball is in, the hitting process does not require additional steps or as much effort to bring the bat into the plane of the ball. Thus, the mind and body perform less work or fewer changes to deliver the bat accurately and precisely to the ball. Reduction of head movement is another form of simplification and improvement. Head movement has a huge impact on the ability of the batter to generate higher quality hits. Therefore, the optimal hitting process (improvement over the current or conventional process) must incorporate steps that eliminate or reduce head movement. This new pivotal swing method makes a significant improvement in reducing head movement by creating an axis to pivot about with a firm foundation that improves the balance of the batter and simplifies the swing at the same time.

Quantitatively in baseball for an example, a five degree rotation of the head in any combination of two of the three dimensions results in about a five inch difference in distance between where the brain may perceive the ball to be compared to its actual position. This misperception can cause the batter to misplace the center of the bat relative to the center of the ball and/or miss the ball. When one realizes there are three 2-plane combinations in which this type of rotation can occur, it becomes readily apparent that increased head movement is a crucial detriment to high quality hits. Further, the games of baseball, fast-pitch softball, and other games that use a similar style of hitting process are unique in that there is a greater penalty for missing the alignment (poor accuracy) of the center of the bat with the center line of the ball by a little than by a lot. For example, in baseball, if a batter misplaces the bat by as little as ¾ inch, it can result in a "pop-up" or slow "grounder" that are usually much easier to convert to an "out" as compared to a line-drive or high quality hit. In comparison, a poor swing, such as missing the center-line of the ball by 3 inches, will typically only result in a "strike," and since it takes three "strikes" before the batter is out, the batter would prefer a strike over a poorly hit ball. Therefore, swing process elements that contribute to precision and accuracy of bat placement will result in better quality hits. These in turn, can make a baseball player a highly successful (and well paid) 0.333 batter who gets a hit in one out of every three at bats, as opposed to a mediocre player who hits 0.250, or one hit in every four at bats.

SUMMARY OF THE INVENTION

This document discloses a training device and method for an improved methodology for a swing that is focused on accuracy without sacrificing power. In short it is referred to as a pivotal swing or a pivoting swing process. The pivotal swing methodology is directed to an improved delivery of a bat to a ball based on four main concepts or areas of improvement: (1) reduced head movement, (2) the bat starting and being delivered in the same plane of travel as the ball (hereinafter referred to as "Bat in Same Plane as Ball"), (3) better balance, and (4) simplification of the swing, which gives a batter more time to observe the ball and decide what action to take. The training device and method are used to develop the batter's skill in performing these four main concepts or improvements, the batter executes many elements that include five main positions or steps: 1) leading or front leg is stiff and straight at the start and during the swing until after contact with the ball is completed (hereinafter referred to as "Straight Front Leg"); 2) the leading or front foot is pointed at least partially in the direction from which the ball is traveling, and does not step or move forward (hereinafter referred to as "No Step"); 3) the hands and the bat are held lower than in conventional starting positions, such that the distal end of the bat is positioned below the shoulders, and the bat is held substantially parallel to the ground at the beginning of the swing (hereinafter referred to as "Low Horizontal Bat"); 4) the bat is delivered in the same plane as the ball is traveling, where the ball is typically traveling in a slightly downward plane and thus the bat will be traveling in a slightly upward plane in the opposite direction of the plane of travel of the ball, and in other words, the bat moves directly forward (hereinafter referred to as "Bat Travels in Same Plane"); and 5) the swing utilizes a pivoting of the trunk and hips about an axis, with no or little forward or lateral movement of the body (hereinafter referred to as "Pivoting about the Axis"). The "axis" referred to here and throughout this application is the equivalent of a "pole" that goes down from above a batter in the ready position and down through the head, neck, torso, entire front stiff and/or straight leg and foot and continuing into the ground. In this pivotal swing process, the body pivots about this axis or pole. It is a simplification that reduces or eliminates head movement and also creates better balance in the overall pivotal swing process. The training device is used to assess and refine the batter's skill and performance of the pivotal swing method. The terms, elements and steps are used interchangeably throughout.

These new and unique combinations of elements after training with the training device have produced an average improvement of over 30% for experienced baseball batters, or those with 8 to 10 years of experience. Though improvement was expected, more than 30% improvement was unexpected and greatly welcomed. Overall, batters ranged in improvement from 20% to 42%. This is dramatic in the sport of baseball. When all players using the method improve significantly, that corresponds with a "core" level process improvement. All people working on process improvement desire to find a "core" level improvement because they can then expect essentially all users of such a new method to get improved results without changing anything else except the process they are following. These improvements are extremely useful when one understands the impact. A 30% improvement in hitting can result in a hitting average improvement of 50 to 100 points, depending on the current skill of each batter and the effectiveness of implementing the pivotal swing process or method. Each "point" referred to herein corresponds to 0.1% batting average; thus 100 points corresponds to a 10% average. A 50-point improvement for a current 0.250 hitter would change him to a 0.300 hitter. Correspondingly, a 100-point improvement for a 0.250 hitter would change him to a 0.350 hitter and in Major League Baseball ("MLB") could result in millions of additional dollars in his contract. Similarly, a 100-point improvement of a 0.320 hitter would make him a 0.420 hitter. That is huge! MLB has not had a batter over 0.400 in over 70 years. There are a lot of 0.320 or higher hitters so it is a very reasonable expectation that such an occurrence will happen. This too could have a multi-million dollar impact on a MLB player's contract. Even more important is the impact for a team. Over the last 20 years in MLB, which is comprised of 30 teams in 2 leagues, the difference between the hitting average of the lowest place team as compared to the highest place team in each league has averaged about 34 points. The usefulness of this training device and training method of the improved pivotal swing method is now obvious. First, it can significantly impact the pay of a MLB player as noted above. Secondly, if a team using this method improves their hitting average by 50 points (possibly as much as 100 points) it can move all the way from the last placed team to the first place team in their league. Though these impacts were unexpected, it is easy to see their usefulness in the game of baseball.

For a 0.300 hitter, a 50 to 100 point improvement is an increase of 16.6% to 33.3%. This increase in efficiency is astounding, not only in the field of baseball, but in many other disciplines. For example, increase in the yield of a crop by 30% would result in a significantly greater supply of that crop, and in all likelihood, significant cost savings to the consumer. The same is true for baseball. An increase of efficiency of 30% in batting average would result in more production for the baseball team. A baseball team would then win more games resulting in higher ticket sales, higher revenues, and higher profits.

A little more explanation about the steps Low Horizontal Bat and Bat Travels in Same Plane may help create an understanding of how they contribute to the overall pivotal swing method. It is basically understood that the bat has to be in the plane of the ball in order for the ball to ever be hit. There is a huge difference in the bat eventually getting there after many elements of the conventional swing have been executed as compared to being in the same plane during the full pivotal swing process. There is also an angle of incidence that is a major cause of reduced time available to make impact. In general, two objects (a bat and ball) that are traveling in different planes will only impact each other if they meet at the same time and point of the 2 intersecting planes at an angle of incidence. However, two objects (for example: a pitched ball in the strike zone and a bat being delivered to that same strike zone) that are traveling in the same plane in opposite directions will essentially always impact each other. This is a huge issue that, if not understood, will seriously impact the understanding of how these two elements contribute to the pivotal swing process and how they are different from the current or conventional swing process. A key benefit is that the amount of energy transfer will be higher when the ball and bat, traveling in opposite directions in the same plane, collide. Another benefit of the training device and training method is that the pivotal swing process is simpler without the added steps needed to get the bat down from the prior art starting position of the conventional swing process to where the ball is. These two elements are useful to the overall results because they contribute to the noted improvements, including reduced head movement, better balance, and simplification of the swing, and are achieved in a unique way that has not been taught or disclosed in the past.

With the steps Low Horizontal Bat and Bat Travels in Same Plane more clearly understood, we can now expand on how they impact the simplification of the overall pivotal swing process. With the Low Horizontal Bat, the bat only needs to be brought directly forward in the plane of the ball. This simplification allows more time to ascertain the direction and spin of the ball and allows the pivotal swing process to deliver the bat more directly and accurately to the ball with reduced head movement and maintaining better balance.

It is important to note how the steps described above and the training devices described below contribute to the improvements of the current invention and how these elements also contribute to unexpected and useful results. However, to list each element individually with all its contributions to each improvement as well as the various combinations of them and their contributions to individual and combinations of improvements would be overly redundant and repetitive. Instead, examples will be provided as representations of all the individual and combined results. One such example was discussed above while explaining some of the special aspects of how the two elements Low Horizontal Bat and Bat Travels in Same Plane contributed to three improvements: simplification of the swing, reduced head movement, and better balance. It should be reasonably clear that either one of those two steps by themselves will contribute to one or more of the improvements. However, the amount of improvement is significantly increased when multiple steps disclosed herein are combined and synergistic benefits are obtained.

An additional example of how the training device helps develop the various elements both individually and in combination contribute to improvements or combinations of improvements includes the steps Straight Front Leg, No Step, and Pivoting about the Axis. Each of these contributes individually to all previously mentioned improvements; however, when they are combined, they produce even higher levels of improvement when compared to each step individually. The Straight Front Leg is a key part of creating the axis upon which to pivot; it builds a firm foundation for better balance. When we add the No Step element, we are maintaining the creation of the axis and maintaining the firm foundation. In addition, it contributes to the simplification of the swing. Upon adding the Pivoting about the Axis step, we continue to maintain the axis and firm foundation while all three steps are contributing to better balance. They are also continuing to add to the simplification of the swing, which is providing synergistic benefits of enhancing the improvements. The first two elements, Straight Front Leg and No Step, are also a key part of achieving the improvement of reduced head movement. The design of the pivotal swing process then was able to add the element of Pivoting about the Axis to create the necessary power in the swing while maintaining the improvements already in place for better balance, reduced head movement, and simplification of the swing. These three steps and the training devices used to develop them in the batter's performance are all synergistically contributing to those three improvements, which in turn allow the batter to more precisely and accurately deliver the bat to the specific location of the ball.

Through these thorough examples, it has been shown the linkages to the design and training of the pivotal swing process and how they add to the contributions and integration of improvements. All five elements are individual improvements upon the conventional or current swing process. The key, as is made evident in the previous explanations, is that each element contributes to multiple improvements thus resulting in an overall improvement that is significantly more than the sum of the separate individual improvements. There are synergistic benefits from their combinations. The training devices used in the batter's development of these five elements are key integral parts of implementing the pivotal swing process that produced some unexpected and extremely beneficial improvements.

To assure the development of the batter in effective implementation of the elements of the Pivotal Swing method, use of training devices is beneficial. An example is the measurement of head movement. A major improvement of the Pivotal Swing method is to eliminate head movement. The actual measurements of how much the head has moved in any of the 3 dimensions will improve the batter's knowledge of performance. Similarly measurements of detrimental leg movements or bending of the knee will also help the batter to fully implement the new method.

Movements can be assessed by use of electronic or mechanical measurements. Electronic measurements are a little easier to capture by use of electronic meters and computers. Mechanical measurements are a little harder for a batter since they are in motion. This condition warrants utilization of an amplifying device, a booster or enlarger to allow the measurements to be seen and identified at a short distance away. When something moves there is a way to boost or enlarge the movement by having an extension of the point of movement. If a point on the batter's body moves 0.5 inch that is harder to see than if a boosting or enlarging device of 7" or 8" is attached to that point. From the point of the observer, the boosting or enlarging of the amount of movement at that point makes it easier to make a video recording of the movement to review at a later time with the batter involved with that assessment. Movements measured either electronically or mechanically with the aid of a booster or enlarger is essential to the training and development of the batter in utilization of the Pivotal Swing method.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES AND TRAINING DEVICES

The accompanying drawings, which are incorporated in and form a part of this specification, illustrate embodiments of the invention and together with the description, serve to explain the principles of this invention.

DETAILED DESCRIPTION OF THE INVENTION

Figure 1:
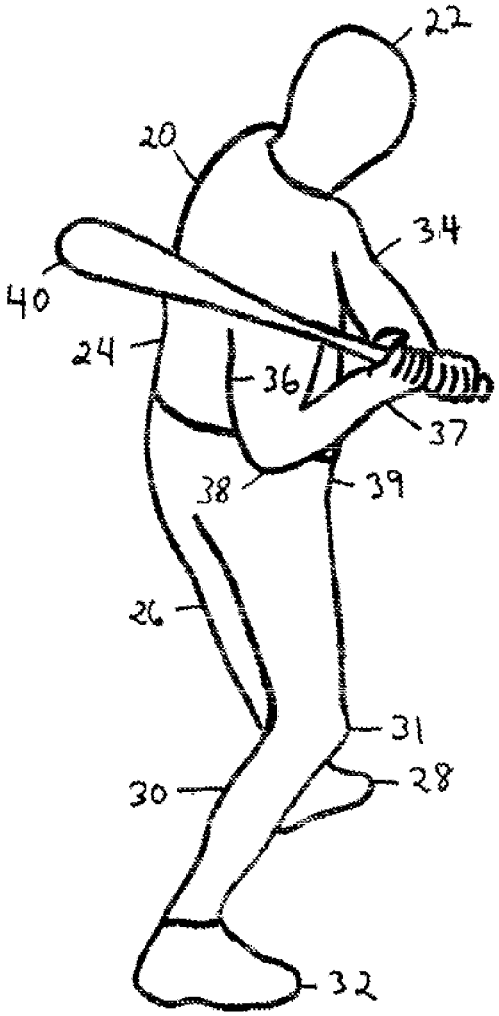
FIG. 1 is a side perspective view of a batter in a ready position for performing the pivotally swinging and hitting method in accordance with exemplary embodiments.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

This document describes training devices and training methods for a pivotal swing process or pivotal hitting technique, embodied in various methods and processes that produce an improved swing process, thereby maximizing swing quality and desired outputs. The following description relates primarily to the context of the game of baseball and fast-pitch softball, with a baseball or softball bat, a type of machine used to change the state of the baseball or softball. The example illustrated by the following figures is a right-handed batter in baseball or softball. The method is equally applicable to a left-handed batter, but it should be understood that for a left-handed batter the various positions and actions are the opposite as are the case, as illustrated here, for a right-handed batter.

To assure the training and development of the batter in effective implementation of the elements of the Pivotal Swing method, use of a training device is beneficial. There are two types; one using electronic measurement (Type 1) and one using mechanical rods (Type 2) referred to herein as enlargers. Both types are used to assess the achievement of the targeted improvements and elements. An example is the measurement of head movement. A major improvement of the Pivotal Swing method is to eliminate head movement. The electronic measurement in the first embodiment of the training device, Type 1, will give actual measurements of how much the head has moved in any of the 3 dimensions. This information can be fed back to the batter so they can better develop their knowledge of and muscle memory to implement the new method most effectively. Similarly measurements of detrimental leg movements or bending of the knee are made.

Mechanical movement can also be assessed by use of mechanical rods or enhancers that increase, boost, enlarge or exaggerate the movements along with a video recording device, Type 2. A video camera is used in conjunction with the mechanical devices to show enlargement or increases of the detrimental movements. If the head 22 is moving during the swing motion, the movement of the enlargers can be captured on video and can show in which direction(s) the head moved by observation of the boosters or enlargers. Performance of the implementation of the various elements of the Pivotal Swing can be used to show the batter by review of the video playback which elements they are doing well or not. They can then make adjustments to improve their execution until the desired level of performance is achieved. Similarly video recording of the leg movement enlargers will show if the leading stiff front leg 26 is moving or knee 29 is bending.

Figure 8:
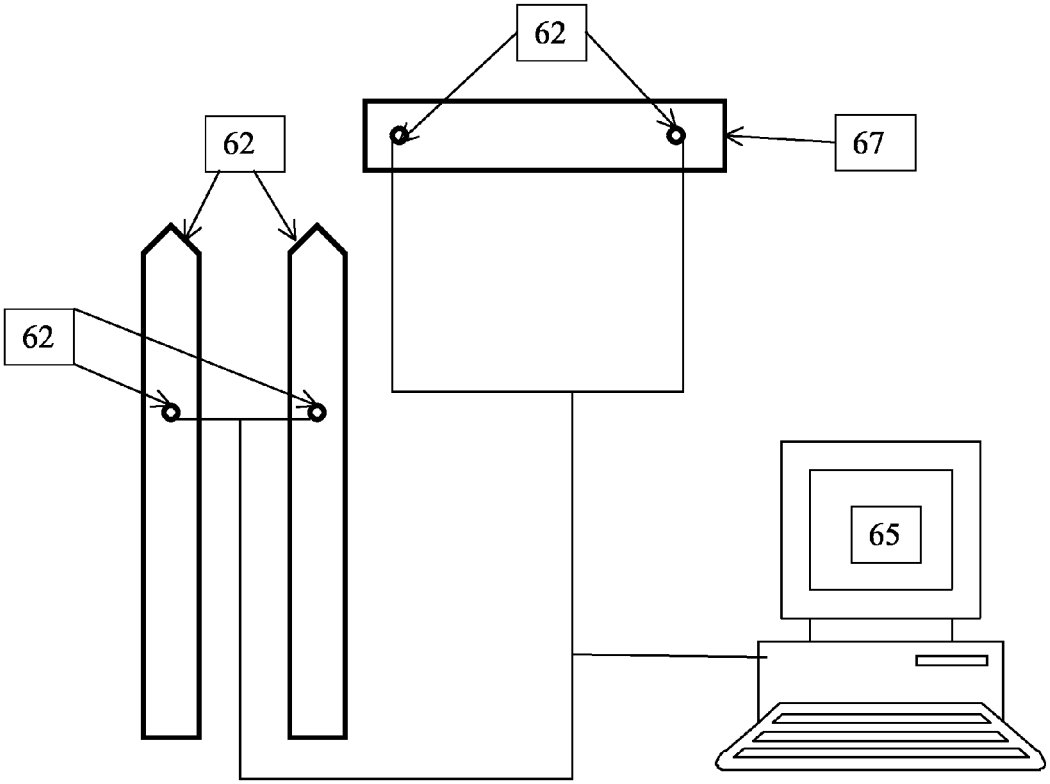
FIG. 8 shows one embodiment of the training device comprising two motion sensors for attaching to the batter's leading leg and one motion sensor for attaching to the batter's head. All sensors are connected by wire or by remote transmission to a computer.

Utilization of Type 1 (as depicted in FIG. 8) is initiated by placement of electronic sensors on the batter. There are 3 sensors 62 used. One is placed on the batters helmet by use of a two part Velcro™ strip; each with adhesive on the back. One source is part number 120P (for 1.5" wide hook material) and 121P (for 1.5" wide loop material) from TEXTOL Systems, Inc. (Carlstadt, N.J.). The loop side of the Velcro™ strip 67, which has adhesive on the back, can be adhered to the helmet. The hook portion of the Velcro™ strip 67 is attached to the electronic sensor 62. The sensor 62 is then secured to the helmet via the Velcro™ strip. When the batter is not being measured, the tear-away portion (in this case the hook portion) of the Velcro™ strip 67 can be removed from the helmet. The sensor 62 for the head movement can be placed either at the center, back of the head 22 (with helmet) or just above the ear on the side of the batter toward the pitcher. Although the sensor 62 could be placed essentially anywhere, interpretation of the readings for feedback to the batter are easier from those two selected locations.

The USB cables/wires are connected to the sensor for transmission of the sensor's 62 output measurements to the meter or computer 65 depending upon which method of reading is being used. The sensor 62 does not need to be placed on the batter's helmet until measurements are ready to be taken. Some of the training can take place without the measurements being taken. The trainer can work with the batter to implement the various elements of the Pivotal Swing method and improve the batter's execution of the method to some degree by visual observation and giving feedback. When the batter gets closer to the desired method, the training device must then be attached to give more precise readings of the amount and direction of the undesirable movements.

Utilizing the referenced items in FIG. 8, said Training Device is comprised of sensors, wires, holding straps and signal sending and receiving devices with applicable software to receive, organize and display the signals from the sensors. Said Training Device can be configured in various ways. One configuration uses wires to connect the sensors 62 (1049—PhidgetSpacial 0/0/3) (Phidgets Inc., Calgary, Canada) to a computer 65, which includes any notebook, desktop computer or the like comprising the operating systems listed below with at least 3 USB ports and a 802.11 b/g/n network card. The output of the sensors 62 can also be captured on a meter or Smartphone with corresponding software applications. For example a meter that could be utilized with the present method includes the UTI-T UT71E Intelligent LCD Digital Multimeter (Shenzhen Graigar Technology Co., Ltd., Guangdong, China), AM-1118 Digital Multimeter (T & M Atlantic, Miami, Fla.) or Apple iPhone 3 (Cupertino, Calif.).

For communications between the sensors 62 and the computer 65, the computer 65 may use one of the following operating systems: Windows (2000 or newer); Mac OS X (OS X 10.4 or newer); or Linux (kernel 2.6 or newer). Computer 65 may also use a number of programming interfaces that provide applications for collecting, manipulating and presenting data supplied from sensors such as the motion sensors used in this method. For example, Phidgets drivers and network protocol software may be used to provide a complete set of application programming interfaces.

For the signals from the sensors 62 to communicate with the primary computer or other computers or devices via wireless operating systems each device will have one of the following mobile operating systems—Windows CE (5.0 or newer), Phidgets SBC (all versions), Android (3.1 or newer), or iOS (3.0 or newer). These systems may also include Phidgets drivers and network protocol software. The computer 65 and other devices may have an 802.11 b/g/n network card or equivalent to send and receive the data via the wireless network and communicate with the sensor 62 using the PhidgetsWebService also available at www.Phidgets.com. Once the sensors 62 are connected to a computer via the USB cables (wires), any of the computers, smartphones or devices on the PhidgetsWebService network can control the sensors 62. Each sensor has a specific identification and commands can be sent to one or all sensors 62 from any device on the PhidgetsWebService network.

In order to display multiple readings on the computer 65 simultaneously the Phidgets outputs can be fed into a third party software such as PCR Automation (from PCRBOX). Other software applications that can be used include PiXCL Advanced Imaging 10.2 (from PiXCL Automation Technologies); Visual Domotique (from MANIPIL); Flowstone (from DSPRobotics); or if using a Mac computer they may need 24U Phidgets Plug-in 1.0 (from 24U) working in conjunction with FileMaker Pro.

Sensors 62 are powered by the USB cable (wire) from the computer 65. Sensors 62 are connected to straps 69 or 67 depending on the location of placement. Strap 67 is attached to the batter's helmet so that sensor 62 is either at the center back of the head 22 or just above the forward ear (ear closest to the pitcher).

Type 1 device may also utilizes two leg straps 69. For example, Velcro™ Brand ONE WRAP® Straps part number 1STRAP13/4X24 BLACK from TEXTOL Systems, Inc. may be used to prepare the leg straps. In these two leg straps 69 the Velcro™ material are similar in length. The pieces may be about 1.5 times the circumference of the leg 26 (the example material is 24 inches in length) including the uniform being worn. The extra length provides the overlap needed to attach the leg strap 69 very securely when wrapped around the leg 26. The sensor 62 is affixed to the strap 69 and positioned so that the sensor 62 is relatively close to being directly between the batter and pitcher at the location on the leg 26 selected. An additional location of the two straps 69 is that one is placed slightly above the knee 29 and the other is slightly below. Most players have a little larger circumference around the leg 26 above as compared to below the knee 29.

As the batter's execution of the key elements of the swing method are improved, the sensors 62 must be attached when the measurements of the movements are harder to discern by visual observation alone. Detrimental movement(s) as small as 0.5 inch of the head or leading leg are of concern. That level of movement cannot be seen unaided by visual observation. Electronic sensors can provide us that level of detail.

In some aspects a single sensor 62 can be utilized on the leg 26 to record movement of the leg 26 in all 3 dimensions. However, information about maintaining the front leg 26 stiff and straight is part of the pivotal axis. Unfortunately, a single sensor 62 cannot give information about whether the front or leading leg 26 is being bent (not being kept stiff and straight). The second sensor 62 can provide that information by comparison of the readings from the two leg sensors.

Though similar in function to Type 1 , Type 2 achieves the same information but by a different method. The Type 2 device comprises physical extender rods, or enhancers, positioned on the batter's helmet and or leading leg. For example, the Type 2 device for the helmet is made of three rods (standard green flexi rod 7.5") and one ½ circle (standard yellow connector: semi-circular) connector (made by K'NEX) [Hatfield, Pa.]. The connector holds three rods in 90 degree perpendicular pattern. Two of them are pointing in exactly opposite directions (180 degrees between them). The third one is perpendicular to those two (90 degrees to each of the other 2 rods and positioned so that it is pointing up and somewhat in alignment with the pivotal axis 50. Movement of the head 22 in any of the 3 dimensions is greatly enlarged by the length of the rods. A small movement is made to look much larger by the length of the rods. A head cap marker is placed on the end of each rod. It will add to the visibility of any movement on any of the rods.

Type 2 may also utilize two leg straps, similar to leg straps 69. The leg straps are made of the same type of Velcro™ material as for the Type 1 Training Device. The length may be about 1.5 times the circumference of the leg just above the knee 29. That length of Velcro™ material provides the overlap needed to securely attach the whole strap and rod movement enlargers around the leg. The Velcro™ strap may have two holes to allow the rods to protrude perpendicular to the leg bone(s). Rods are mounted or secured perpendicular to a round gear (K'NEX standard yellow gear 2.25" diameter) with a mounting socket in the center for the rod to be located and fixed at 90 degrees perpendicular to the flat surface of the round gear. The strap is wide enough to securely hold the round gears in place against the leg of the batter. Each round gear is the base for the rod so it will not shift if the leg 26 moves. Rod movement enlargers (7.5") are the same type as in the head assembly. The Velcro™ strap may have two holes that are positioned so that that one rod is directly between the batter and pitcher at the location on the leg 26 selected. A second hole may be positioned so that it will place the $2^{nd}$ rod movement enlarger pointing way from the batter's back of the leg 26. This will produce a Velcro™ strap unit with two rod movement enlargers, each mounted in a round gear held against the leg 26 by the strap 69 with the rods protruding through the designated holes with one pointing away from batter toward the pitcher and the other pointing away from the back of the batter's leading leg 26. The strap is wrapped around the leading leg 26 just above the knee 29. Head cap markers are placed on each of the rod movement enlargers as was done in the head assembly. The $2^{nd}$ leg strap is the same however it is positioned just below the knee 29 with the rods protruding in the same directions as the strap above the knee 29.

With just one set of movement enlarger rods we can see leg 26 movement. However with a second set of movement enlargers any bending of the knee 29 will produce a visible change in the backward protruding movement enlargers.

Another element of the Type 2 Training Device is utilization of a video camera. A video camera mounted on a stable base (such as a tri-pod) adds to the effectiveness. By video recording the swing motion of the batter utilizing the Type 2movement enlargers, the trainer can not only see the movements, they can also replay them for the batter. This is very effective for the batter to observe what is happening with their own eyes. It is much easier to see and assess the undesirable movements with the movement rods or enlargers.

Some of the training of a batter can take place without video recording. The trainer can work with the batter to implement the various elements of the Pivotal Swing method and improve the hitter's execution of the method to some degree by visual observation and giving verbal feedback. When the hitter gets closer to the desired method, the video camera can then be used to give more precise feedback to the hitter of the amount and direction of the undesirable movements.

In accordance with various embodiments, the training devices and training methods of the pivotal swing method has four main concepts or areas of improvement: 1) reduced head movement; 2) the bat is started, moved and delivered to a ball in the same plane of the ball as the ball moves through the air toward the batter (Bat in Same Plane as Ball); 3) better balance, and 4) the swing process is simplified; the end result being that the overall pivotal swing process is simplified, from the conventional swing processes, which gives a batter more time to see the ball. As discussed previously, to accomplish these four main concepts or areas of improvement, the batter executes many elements, or steps, that include five main positions or elements of the preferred embodiment of the invention: 1) Straight Front Leg, 2) No Step; 3) Low Horizontal Bat; 4) Bat Travels in Same Plane; and 5) Pivoting about the Axis.

Figure 2:
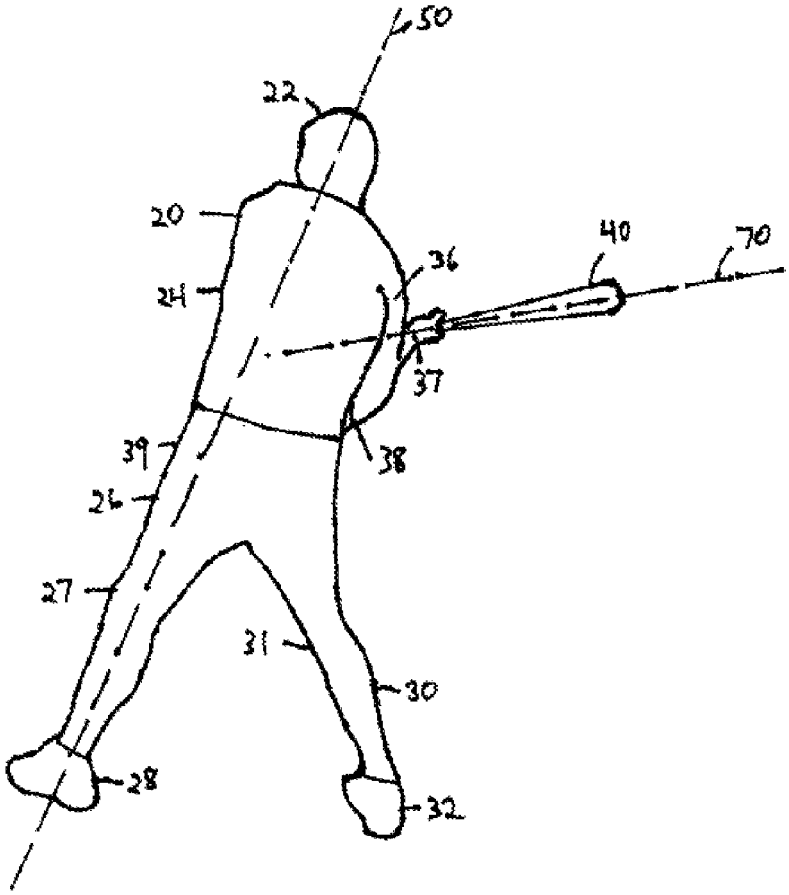
FIG. 2 is a back perspective view of a batter in a ready position for performing the pivotally swinging and hitting method in accordance with exemplary embodiments.
Figure 3:
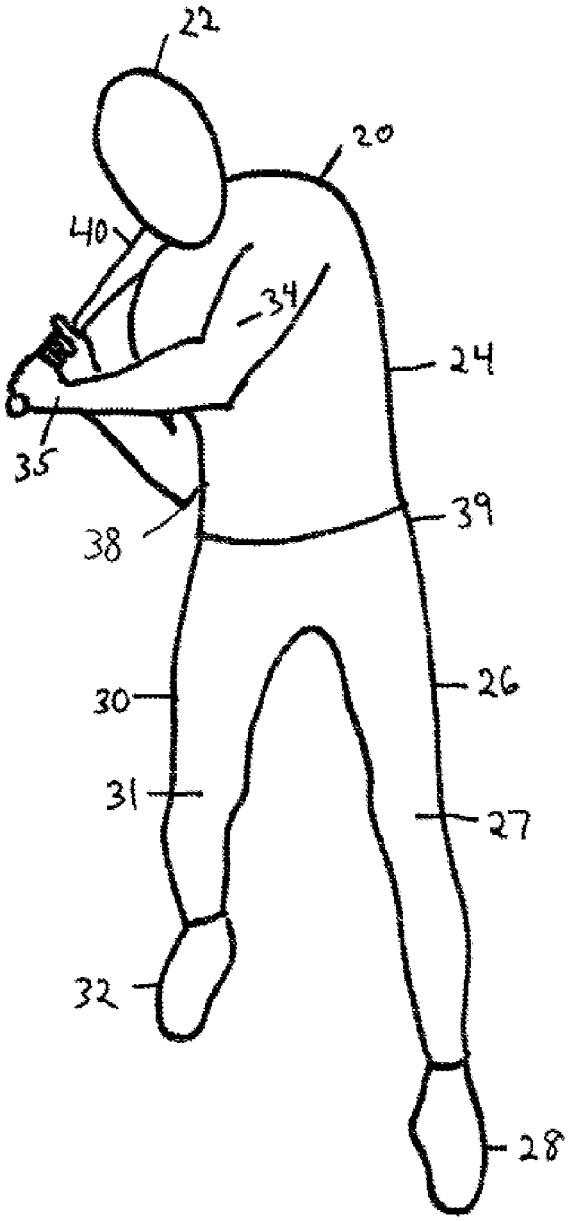
FIG. 3 is a front perspective view of a batter in a ready position for performing the pivotally swinging and hitting method in accordance with exemplary embodiments.

These concepts or improvements, and the associated positions, elements and movements, will now be described in further detail with reference to FIGS. 1-7, which illustrate the techniques described herein with respect to a right-handed batter. The technique is the same, albeit a mirror image, for a left-handed batter. FIGS. 1-3 show the starting or ready position for the batter 20. The ready position is a position where batter 20 is holding a bat 40 and is preparing to swing bat 40 to hit a ball (not shown) that travels from a location away from the batter, i.e. where the batter is waiting for a baseball pitch, for example. The ready position as shown in FIG. 2 defines a ready position axis 50, that extends from above and down through the batter's head 22, torso 24, left leg 26 and left foot 28. Alternatively, the ready position axis 50 extends from above and down through head 22, torso 24, and close to the batter's left leg 26, but aligned much closer to the batter's left foot 28 than to the center point between the batter's right foot 32 and left foot 28. During a swing, batter 20 pivots about the ready position axis 50, to create power yet minimize movement of head 22, while also simplifying the swing.

FIG. 1 depicts a side view, FIG. 2 depicts a back view and FIG. 3 depicts a front view of the ready position. In accordance with the pivotal swing method for hitting a ball, many elements are executed by batter 20, including five key elements. First, the leading or front leg (shown in FIGS. 1, 2, and 3 as left leg 26) is straight and stiff (Straight Front Leg), and batter 20 pushes with the right leg and foot against it, which counteracts or prevents lateral or forward movement of the batter's body during the swing and also keeps the body weight more evenly distributed over both feet. The knee 27 of the leading or front leg 26 is not bent and the foot 28 is pointed at least partially toward the direction from which the ball is coming This will aid in the Pivoting about the Axis 50 portion of the swing later. Along with the straightened front leg 26 there is no step, stride, slide or forward movement made with front foot 28 or the straightened front leg 26, to generate no lateral or forward movement of the batter's body and contributes to little or no movement of head 22 and simplification of the swing (No Step). Pushing against the straightened front leg 26 with no step being made facilitates a full pivoting or pivotal movement about axis 50 during the swing, as well as prevents the 'forward lunging' caused when the batter is fooled by a curveball or change-up because the weight is kept more evenly distributed over both feet during the main part of the swing. Straightened front leg 26 remains straight and stiff during the ready position and for most of the pivotal swing method thereafter. After contact with the ball is made, straightened front leg 26 can then be bent or released.

Second, the left arm 34 and right arm 36 are bent, and the left wrist 35 and right wrist 37 are cocked backward and positioned as shown in FIGS. 1, 2 and 3. Right elbow 38 is down and close to the torso 24, left upper arm 34 is against the left side of torso 24. Right arm 36 is down and tucked against torso 24. Right wrist 37 is positioned to place bat 40 back and down so it is close to parallel to the horizontal plane 70 in FIG. 2 (Low Horizontal Bat). In this fashion, the bat is ready to be moved forward when batter 20 pivots the hips 39 and torso 24 about axis 50. That pivoting will deliver bat 40 in a plane very close to, if not in the same plane as, the ball. This pivoting, positioning and method contribute to the simplification of the swing.

Third, right leg 30, the trailing leg, is bent with the knee 31 dipped slightly toward the ground. Fourth, the hips 39 are substantially "closed," but slightly "open" to facilitate both eyes being positioned to clearly see the full view of the pitcher and allowing for both right and left eye-dominant batters to have full utilization of both eyes. The term "closed" as used in this context refers to hips facing away from the pitcher, while "open" as used in this context refers to hips facing towards the pitcher. Fifth, head 22 is slightly cocked to a hitting position; for example, the position the head will be in when hitting, so that no head movement is necessary during the swing. The slightly cocked head 22 is also part of being in alignment with axis 50 and stays there during the swing until after contact is made.

Additionally, bat 40 is positioned and aligned in plane 70 as shown in FIG. 2, which is as near parallel with the ground as possible. This puts the bat 40 in or near an initial plane that coincides with the typical trajectory of the ball. This position puts the hands and the bat significantly lower when compared to current and historical practice and theory, as can be seen by watching any major league player on the television, essentially all of which begin with the bat held completely vertical and above the shoulders.

When the batter is in the ready position as shown in FIG. 2, the bat can be moved straight forward in the plane 70 by pivoting the hips 39 and torso 24 about axis 50 without having to change planes, which is a unique simplification that reduces the steps and time to bring the bat to the ball. Comparing that with a traditional swing, we find that the first thing the batter must do upon deciding to swing at a ball is to change the location and angle of the bat from far above the shoulder level down toward where the ball will be at the time his bat crosses the projected trajectory of the ball. The positioning taught by this invention contributes to the simplification of the swing. This allows a batter more time to watch the pitch before executing the pivot of the hips 39 and torso 24 about axis 50 for delivery of the bat, because the pivoting swing movement is more direct toward the ball and takes less time. With more time to watch the ball, the batter can make a better determination as to whether the incoming ball or pitch will be a "ball" or a "strike," and will have more time to try to deduce what kind of pitch is being thrown, as a curveball will have different movement and will get to the plate in a different manner than a change-up, slider, fastball, sinker, or other pitch.

The bat 40 being swung in the same plane as the ball reduces difficulties of timing (Bat Travels in Same Plane). The batter has more time and uses less effort to implement the pivotal swing with the best timing to hit the ball. Aligning the angle of the plane of bat 40 in the 'ready' position prior to the pivot to that of the ball's trajectory means more time for the batter to have the bat in the right plane and overall position for a good hit. Conversely, if bat 40 is in a plane that only briefly intersects with the plane of the ball, as is the case with most contemporary or conventional batters, the time available in which to hit the ball is greatly reduced, and there is a lower probability of hitting the ball which also reduces the probability of getting high quality hits. Put another way, the optimal connection occurs when the centerline of the bat hits the centerline of the ball and reverses the direction of the ball to nearly or even exactly the opposite direction it had been traveling. The greater the angle at which bat 40 and the ball intersect, the greater the reduction of the very small window of time in which to make a good connection with the bat to the ball. In other words, it negatively affects the timing of the swing. A very small improvement in the timing generates a huge impact on improving the desired results of high quality hits. It is important to keep in mind that the initial alignment and the delivery of the swing plane are part of the simplification of the swing.

Figure 4:
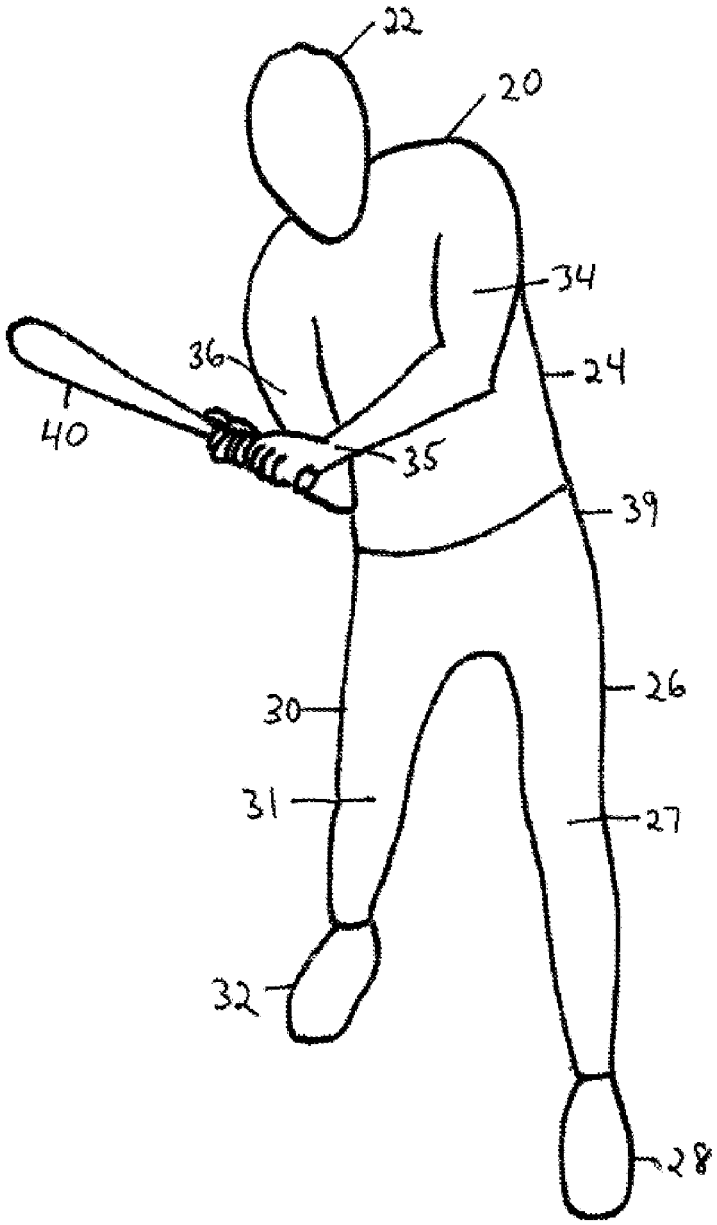
FIG. 4 shows the early position of the pivotally swinging and hitting method according to exemplary embodiments.

FIG. 4 shows the start of the swing in the pivoting swing method. The start of the swing is also the start of the pivot by batter 20 about axis 50 (Pivoting about the Axis 50). Since there is no step forward with the straight and stiff front left leg 26 with unbent knee 27, there is no timing required for a forward step in the pivotal swing process. With no step or weight shifting forward, the batter 20 will not be fooled, which causes an imbalance, by fast and/or off-speed pitches. Batter 20 also has more time to decide what type of pitch it is and which pitch to swing at. Batter 20 can then execute the simplified pivotal swing process keeping the body weight evenly distributed over both feet, thereby achieving better balance. The pivotal swing method minimizes unnecessary motions, including detrimental head movement, that inhibit effective delivery of bat 40 to the ball. These are elements or factors in the simplification of the swing. As shown in FIG. 4, left arm 34 and right arm 36 do not move significantly or change from the ready position shown in FIGS. 1-3. Only hips 39 have started to pivot about the axis 50. The position of the head 22, left arm 34 and right arm 36, and left leg 26 and right leg 30 are kept relatively the same, at least initially.

Figure 5:
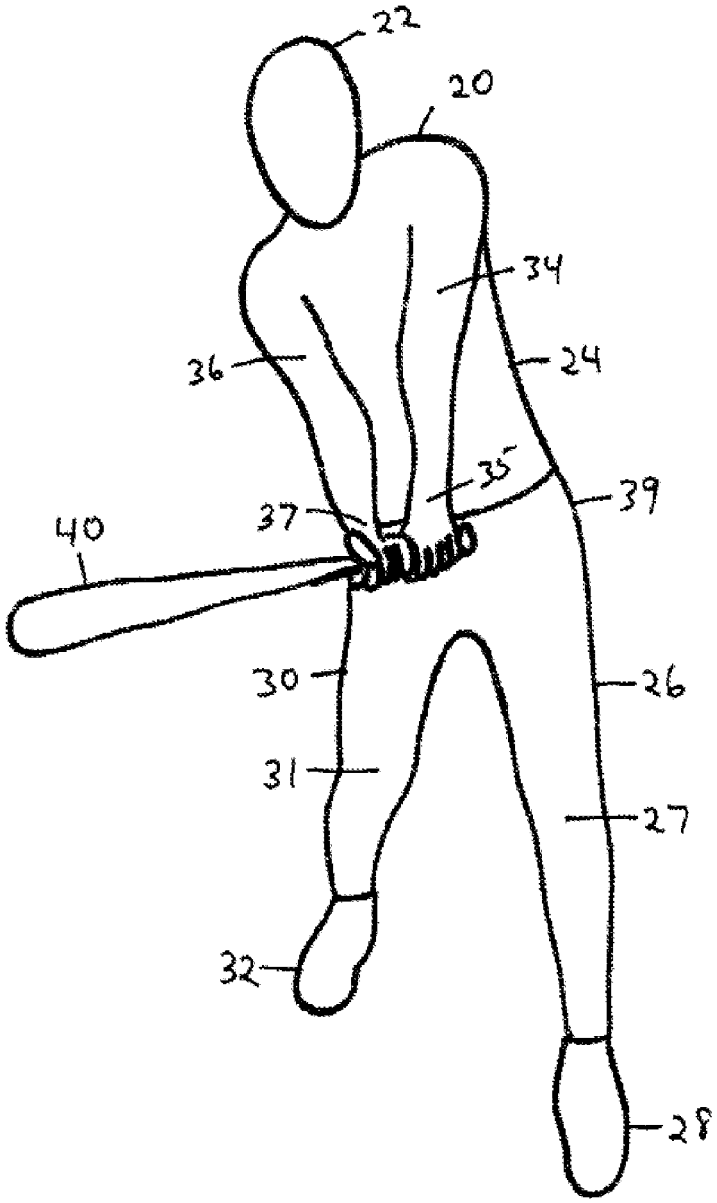
FIG. 5 shows an intermediate position of the pivotally swinging and hitting method in accordance with exemplary embodiments.

FIG. 5 shows a mid-position of the swing. Hips 39 continue to pivot about the axis 50. Torso 24 starts to also pivot around axis 50. During this mid position, batter 20 will start to decide to drive the hands toward the ball for a pitched ball the batter desires to hit. In this case, the arms first unbend, and then the wrists uncock in a timed fashion such that the bat meets the ball just a little in front of the batter. The palms of the hands are essentially juxtaposed to each other (i.e. leading arm is palm down and other arm is palm up), and the arms are approximately fully extended. In this condition, batter 20 is in a position to hit the ball.

Figure 6:
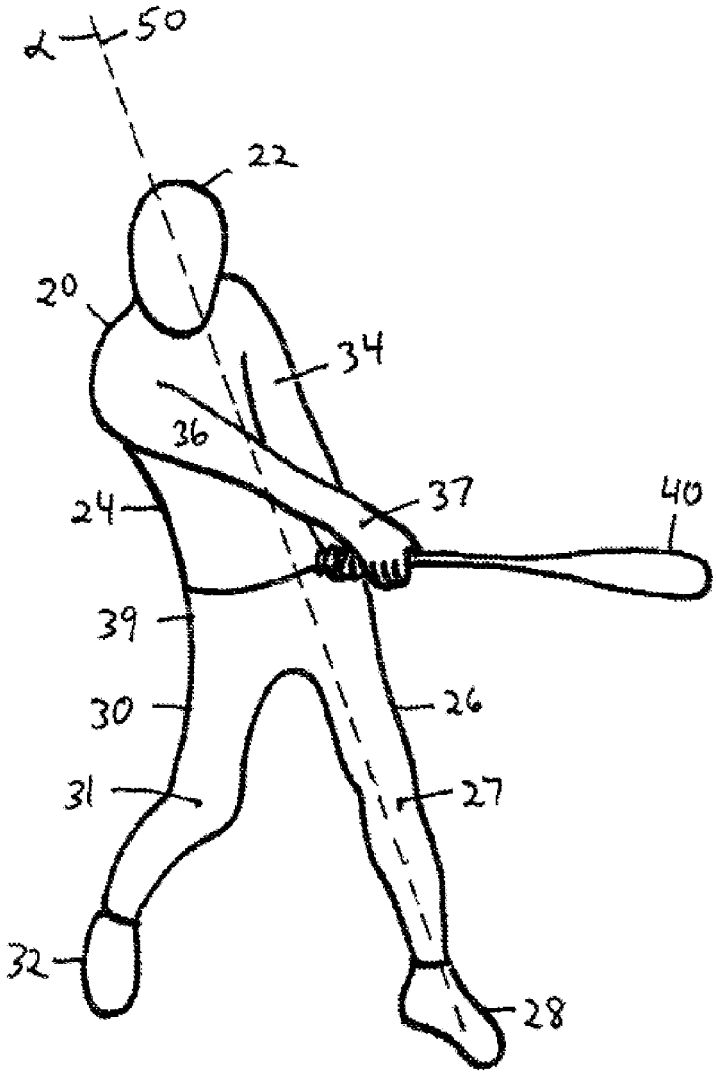
FIG. 6 shows a later position of the pivotally swinging and hitting method in accordance with exemplary embodiments.

FIG. 6 illustrates the continuation of the pivoting about the axis 50. Stiff and straight front left leg 26 and bent right leg 30 and head 22 are not moved, thereby allowing the batter to concentrate on hitting the ball without additional confounding variables such as adjusting the swing to account for the movement of his head. As the hands reach maximum extension from the body they now start to follow the pivoting with the rest of the body about axis 50. In order to maintain or increase the speed of bat 40 while keeping bat 40 in the plane of the ball, the right hand crosses over the left largely due to the momentum of the barrel of bat 40. This also minimizes or eliminates movement of head 22 from the swing. Bat 40 is still traveling in a slightly upward plane, which is opposite of the projected downward plane of the ball. Stiff and straight front left leg 26 with unbent left knee 27 and left foot 28 are being pushed against as part of the extension of axis 50 which is being pivoted about. These forces result in the batter's body not moving forward. The right leg 30 is bent at the knee to drive off of the foot and to keep the swing powerful without significant head movement. The fact that there is little or no head movement in the delivery of a pivotal swing results in a better quality hit.

Figure 7:
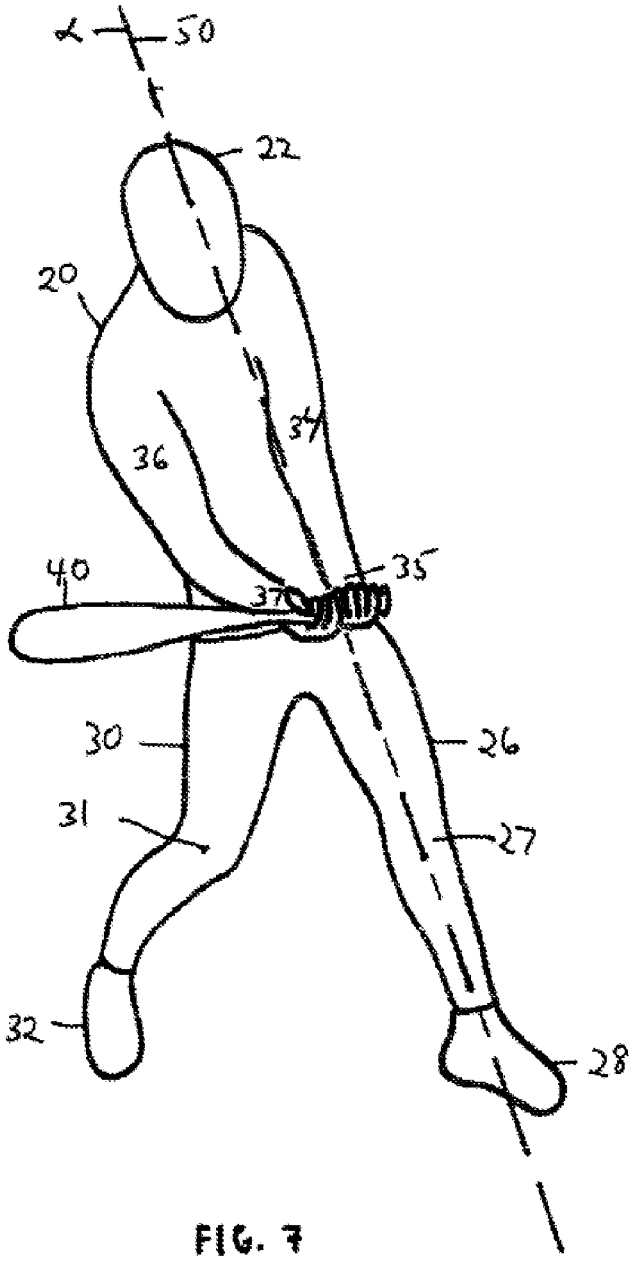
FIG. 7 shows another view of the intermediate position oft pivotally swinging and hitting method in accordance with the exemplary embodiments.

FIG. 7 shows another view of the intermediate position of the swing, focusing on axis 50. Hips 39 continue to pivot about axis 50. Torso 24 starts to also pivot about axis 50. During this mid position, batter 20 will decide to drive the hands toward the ball for a pitched ball the batter desires to hit. In this case, the arms first unbend, and then the wrists uncock in a timed fashion such that the bat meets the ball just a little in front of the batter. The palms of the hands are essentially juxtaposed to each other, for example, the leading arm is palm down and other arm is palm up, and the arms are approximately fully extended. In this condition, batter 20 is in a position to hit the ball.

The speed of bat 40 is provided by pivoting the batter's hips 39 and torso 24 about axis 50 along with extension of the arms and hands toward the ball and the uncocking of both wrists. When the arms (34 and 36) are extended, the wrists (35 and 37) are uncocked and the hips 39 and torso 24 pivot about axis 50; the speed of bat 40 is also provided by passing the hand of the back arm 36 over the top of the front arm's 34 hand. The timing and combination of these components creates the maximum impact to the ball from the bat 40.

In some embodiments, bat 40 is positioned at the start of a swing in a plane that is substantially parallel to the ground. The batter swings bat 40 with a pivot about axis 50 motion, with a stiff and straight front leg, without lifting or stepping forward with the forward leg or foot. This keeps the process simple and eliminates or minimizes head movement. With bat 40 already located in or close to the plane the ball is traveling in and with only a pivoting motion, the pivotal swing process is simplified from conventional swing methods to give a quicker and more accurate delivery of the bat to the ball in a shorter amount of time. This gives the batter more time to assess the location and activity of the ball, contributing to improved results by the batter.

Not all of these steps or elements are required to be executed in one swing to fall within the scope of some embodiments described herein. While a method that employs any one of the elements, movements, techniques, or various combinations of them will realize beneficial results, it is the combination of these elements or steps that produced significant an unexpected improvements over the prior art. As with many processes or process improvements, the degree of effective execution by each player will significantly affect the outcome (or outputs) being measured.

Usage of both Types (1 and 2 or electronic measurement and mechanical movement) of Training Devices is used to assure the implementation of the Pivotal Swing key elements. Measurement of head 22 movement is made and given to the batter for training and adjustment. Similarly assessment of whether the leading leg 26 (right-handed batter) was moved or leading leg knee 29 was bent instead of stiff and straight, can be made with either type of training device. Changes from the desired method can be assessed by both types of training devices for the development of the batter and improved implementation of the Pivotal Swing method.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

The invention claimed is:

1. A training method for improving a batter's accuracy of contacting an incoming ball when swinging a bat comprising the steps of:

positioning said batter so that said batter's leading leg is straight, stationary and positioned toward the direction of said incoming ball, the proximal end of said bat is held in both hands of said batter, directed toward said incoming ball and positioned below said batter's shoulders, the distal end of said bat is positioned behind said batter's shoulders and said batter's head is fixed and directed toward said incoming ball, said positioning creating a pivotal axis that extends down and through the top of said batter's head, shoulders, torso, hips and leading leg;

affixing at least two motion sensors to said batter, wherein one sensor is placed on said batter's head and one sensor is placed on said batter's leading leg and monitoring said motion sensors as said batter swings to generate information about said batter when swinging said bat;

wherein said batter receives said information that allows said batter to maintain said fixed position wherein said fixed position consists of said batter's head being fixed and pivoting said shoulders, said torso and said hips about said pivotal axis whereby said fixed position of said head, said straight and stationary placement of said leading leg during said pivoting with no shift of weight to said leading leg thereby improving said batter's accuracy of contacting said incoming ball when swinging said bat on subsequent swings.

2. The training method according to claim 1, wherein said batter's swing comprises said bat being swung within a swing plane substantially coincident with a movement plane associated with a projected travel path of said incoming ball.

3. The training method according to claim 1, wherein the step of positioning further comprising the step of pointing said leading leg foot at least partially in the direction of said incoming ball before swinging said bat.

4. The training device and training method according to claim 1, wherein the step of positioning further comprising the step of orienting said bat such that it is substantially parallel to the ground before swinging said bat.

5. A training method according to claim 1, wherein said batter's swing comprises the following steps in order:

providing said batter in a ready position waiting for said baseball to be thrown by a pitcher, wherein said ready position comprises, a stiff and straight leading leg, a back leg which is bent, hands holding the proximal end of said bat and directed toward said pitcher, said longitudinal axis of said bat positioned substantially parallel to the ground and about the vertical middle of the strike zone close to said batter's torso, and a fixed position of said batter's head directed toward said pitcher;

maintaining said stiff and straight leading leg while said baseball is thrown by said pitcher and while said baseball travels towards said batter;

starting said swing, wherein starting said swing comprises maintaining said stiff and straight leading leg, pivoting said hips of said batter around a defined pivotal axis, then moving said bat and said hands in a forward direction and not in a downward direction, maintaining said longitudinal axis of said bat substantially parallel to the ground, wherein said defined pivotal axis extends down and through said batter's head, through said batter's shoulders, torso, hips and through said batter's leading leg;

continuing said swing, wherein continuing said swing comprises maintaining said fixed position of said head, maintaining said stiff and straight leading leg, maintaining said longitudinal axis of said bat substantially parallel to the ground, moving said batter's hands away from said torso as said bat moves towards said baseball, and pivoting said hips, torso and shoulders of said batter around said defined pivotal axis; and finishing said swing, wherein finishing said swing comprises maintaining said fixed position of said head and maintaining said stiff and straight leading leg; whereby the batter's weight does not shift forward during said swing.

6. The training method according to claim 5, wherein said ready position further comprising pointing the foot of said leading leg at least partially in the direction of said baseball before swinging said bat.

7. A training method for improving a batter's accuracy of contacting a baseball when swinging a bat comprising the following steps in order:

providing said batter in a ready position waiting for said baseball to be thrown by a pitcher, wherein said ready position comprises, a stiff and straight leading leg, a back leg which is bent, hands holding the proximal end of said bat and directed toward said pitcher, said longitudinal axis of said bat positioned substantially parallel to the ground and about the vertical middle of the strike zone close to said batter's torso, and a fixed position of said batter's head directed toward said pitcher;

maintaining said stiff and straight leading leg while said baseball is thrown by said pitcher and while said baseball travels towards said batter;

affixing at least two motion sensors to said batter, wherein one sensor is placed on said batter's head and one sensor is placed on said batter's leading leg and monitoring said motion sensors to generate information about said batter when swinging said bat;

starting said swing, wherein starting said swing comprises maintaining said stiff and straight leading leg, pivoting said hips of said batter around a defined pivotal axis, then moving said bat and said hands in a forward direction and not in a downward direction, maintaining said longitudinal axis of said bat substantially parallel to the ground, wherein said defined pivotal axis extends down and through said batter's head, through said batter's shoulders, torso, hips and through said batter's leading leg;

continuing said swing, wherein continuing said swing comprises maintaining said fixed position of said head, maintaining said stiff and straight leading leg, maintaining said longitudinal axis of said bat substantially parallel to the ground, moving said batter's hands away from said torso as said bat moves towards said baseball, and pivoting said hips, torso and shoulders of said batter around said defined pivotal axis; and finishing said swing, wherein finishing said swing comprises maintaining said fixed position of said head and maintaining said stiff and straight leading leg; whereby the batter's weight does not shift forward during said swing, wherein said batter receives said information that allows said batter to maintain said fixed position on subsequent swings thereby improving said batter's accuracy of contacting said incoming ball when swinging said bat.

8. The method according to claim 7, wherein said ready position further comprising pointing the foot of said leading leg at least partially in the direction of said baseball before swinging said bat.

* * * * *